US008550584B2

(12) United States Patent
Kim

(10) Patent No.: US 8,550,584 B2
(45) Date of Patent: Oct. 8, 2013

(54) METHOD OF INKJET PRINTING PIXELS

(75) Inventor: Jae-Hoon Kim, Cheonan-si (KR)

(73) Assignee: Samsung Display Co., Ltd., Yongin (KR)

( * ) Notice: Subject to any disclaimer, the term of this patent is extended or adjusted under 35 U.S.C. 154(b) by 335 days.

(21) Appl. No.: 13/035,318

(22) Filed: Feb. 25, 2011

(65) Prior Publication Data

US 2012/0105521 A1 May 3, 2012

(30) Foreign Application Priority Data

Oct. 29, 2010 (KR) ..... 10-2010-0106854

(51) Int. Cl.
*B41J 29/38* (2006.01)

(52) U.S. Cl.
USPC ..... 347/9; 347/14; 347/15; 347/19

(58) Field of Classification Search
USPC ..... 347/5, 9, 10, 13, 19, 20, 14, 15, 40–43; 445/24, 25; 349/106
IPC ..... B41J 29/38
See application file for complete search history.

(56) References Cited

U.S. PATENT DOCUMENTS

| | | | | |
|---|---|---|---|---|
| 4,638,373 | A | 1/1987 | Logan | |
| 2007/0085890 | A1* | 4/2007 | Hasebe et al. | 347/102 |
| 2007/0285454 | A1 | 12/2007 | Shang et al. | |
| 2008/0309698 | A1 | 12/2008 | Nakano et al. | |
| 2009/0184990 | A1* | 7/2009 | Shang et al. | 347/6 |
| 2009/0185186 | A1* | 7/2009 | Shang et al. | 356/432 |
| 2009/0251504 | A1* | 10/2009 | White | 347/14 |
| 2010/0156968 | A1* | 6/2010 | Seo et al. | 347/3 |
| 2010/0156971 | A1* | 6/2010 | Ikeda et al. | 347/9 |

FOREIGN PATENT DOCUMENTS

| | | |
|---|---|---|
| JP | 2003-004420 | 1/2003 |
| JP | 2003-269925 | 9/2003 |
| JP | 2005-093099 | 4/2005 |
| JP | 2006-305735 | 11/2006 |
| JP | 2008-018423 | 1/2008 |
| JP | 2009-029118 | 2/2009 |
| JP | 2009-248045 | 10/2009 |
| JP | 2009-251061 | 10/2009 |
| JP | 2009-285910 | 12/2009 |
| KR | 1020070082386 | 8/2007 |
| KR | 100781997 | 11/2007 |
| KR | 1020090076602 | 7/2009 |
| KR | 1020100009927 | 1/2010 |

* cited by examiner

*Primary Examiner* — Manish S Shah
*Assistant Examiner* — Roger W Pisha, II
(74) *Attorney, Agent, or Firm* — H.C. Park & Associates, PLC

(57) ABSTRACT

Aspects of the present invention provide a method of inkjet printing pixels, the method including: applying ink to a plurality of pixels using an inkjet printer; calculating a Transmittance Measurement System (TMS) value of each of the pixels, by measuring an amount of light transmitted through each pixel before and after the application of the ink; calculating a TMS difference between the TMS values of two adjacent pixels; and adjusting the amount of ink applied to each pixel, on the basis of an average of the TMS values of two adjacent pixels, when the absolute value of one of the TMS differences is larger than a reference value.

10 Claims, 5 Drawing Sheets

METHOD OF INKJET PRINTING PIXELS

CROSS-REFERENCE TO RELATED APPLICATION

This application claims priority to and the benefit of Korean Patent Application No. 10-2010-0106854 filed on Oct. 29, 2010, which is hereby incorporated by reference for all purposes as if fully set forth herein.

BACKGROUND OF THE INVENTION

1. Field of the Invention

Various embodiments of the present invention relate to a method for inkjet printing pixels.

2. Discussion of the Related Art

A liquid crystal display includes pixels including switching elements, gate lines, is and data lines. Such a display further includes a color filter for displaying a full color image. The color filter may be classified as a photolithography-type or an inkjet printing-type, according to the manufacturing method thereof.

In the inkjet printing-type, a light blocking member, such as a black matrix, or the like, is stacked on an insulation substrate. Openings are formed in the light blocking member corresponding to the pixels, through exposure and development processes, and ink for the color filter is applied into the openings.

The ink is applied using an inkjet head having a plurality of nozzles. Different amounts of ink are discharged from the nozzles. That is, different amounts of ink are applied to different pixels. Stains are formed by differences in the amounts of ink applied to the pixels. Accordingly, the amount of ink applied to each pixel should be adjusted for uniformity, by adjusting the amount of ink discharged from each nozzle.

In the related art, the amounts of ink applied to all pixels are adjusted by comparing each pixel to a reference value. In this case, for a pixel having a wide deviation from a reference value, the amount of discharged ink is frequently corrected. As a result, an inkjet process time increases and the total production time is lengthened.

The above information disclosed in this Background section is only for enhancement of understanding of the background of the invention, and therefore, it may contain information that does not constitute prior art.

SUMMARY OF THE INVENTION

Aspects of the present invention provide a method of inkjet printing pixels, having an advantage of preventing stains from being displayed, by adjusting an amount of ink applied to is each pixel.

An exemplary embodiment of the present invention provides a method of inkjet printing pixels including: applying ink to a plurality of pixels using an inkjet printer including an inkjet head with a plurality of nozzles; calculating a Transmittance Measurement System (TMS) value of each of the pixels by measuring an amount of light transmitted through each pixel, and calculating a difference in the TMS values of two adjacent pixels; and adjusting the amount of ink applied to each pixel, on the basis of an average of the TMS values of two adjacent pixels, when the absolute value of the difference in TMS values is larger than a reference value. The TMS value represents a value acquired by dividing an amount of transmitted light when ink is included in the pixel, by an amount of transmitted light when no ink is included in the pixel.

According to exemplary embodiments of the present invention, it is possible to prevent stains from being displayed by adjusting an amount of ink dropped to each pixel at the small number of times.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE EXEMPLARY EMBODIMENTS

Figure 1:
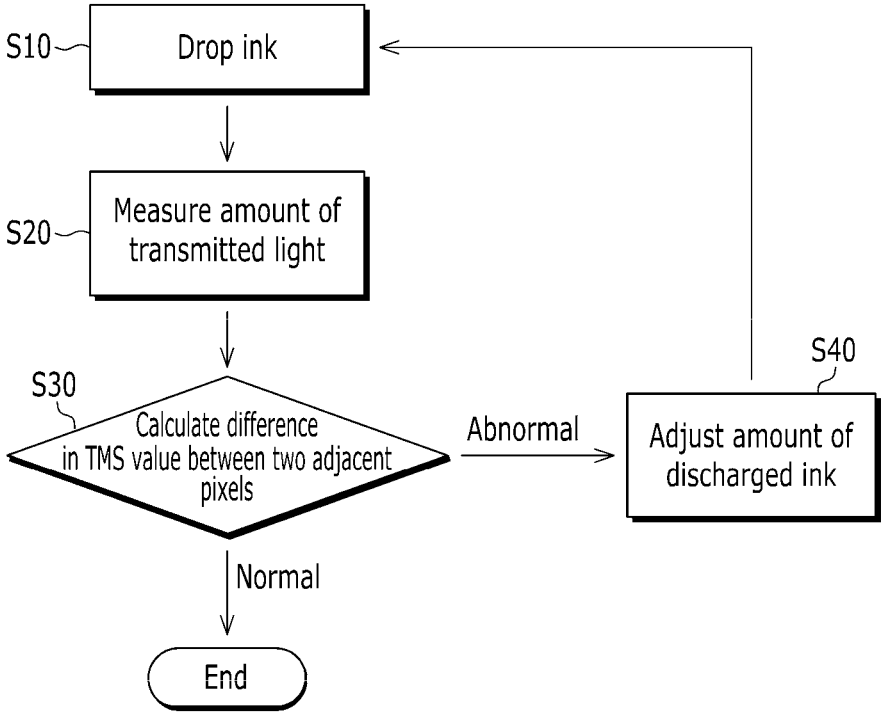
FIG. 1 is a flowchart illustrating a method of inkjet printing pixels, according to an exemplary embodiment of the present invention.

The aspects of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

FIG. 1 is a flowchart illustrating a method of inkjet printing pixels, according to an exemplary embodiment of the present invention. As shown in FIG. 1, ink is applied to each pixel (S10). An inkjet printer, including an inkjet head with a plurality of nozzles, is used to apply ink to each pixel. Ink is applied to each pixel by discharging ink from each nozzle to corresponding sub-pixels of each pixel. The ink includes red, green, and blue inks, which are used to form red, green, and blue sub-pixels of each pixel.

Subsequently, the light transmission amount of each sub-pixel is measured (S20). Light is transmitted to each pixel to which ink is applied, from a light source. The amount of light transmitted through each pixel is measured using a charge-coupled device (CCD) camera. The amount of ink applied to each pixel may be determined by measuring the amount of transmitted light. As the thickness of the ink increases, the amount of transmitted light decreases, and as the thickness of the ink decreases, the amount of transmitted light increases.

Herein, the thicknesses of inks applied to each sub-pixel of the pixels are compared with each other using a Transmittance Measurement System (TMS) value, and the TMS value represents a value acquired by dividing an amount of transmitted light before and after ink is applied to each pixel. That is, as the thickness of ink increases the TMS value decreases, and as the thickness of ink decreases the TMS value increases.

TMS values for sub-pixels and spectrometry values for sub-pixels are compared with each other as follows:

Spectrometry value of red sub-pixel=−0.8715×TMS value of red pixel+0.8802;

Spectrometry value of green sub-pixel=−0.3918×TMS value of green pixel+0.7676;

and

Spectrometry value of blue sub-pixel=0.7465×TMS value of blue pixel−0.1388.

In the case of the red sub-pixel, the spectrometry value is changed by 0.0009 per a TMS value of 0.001. In the case of the green sub-pixel, the spectrometry value is changed by 0.0004 per the TMS value of 0.001. In the case of the blue sub-pixel, the spectrometry value is changed by 0.0007 per the TMS value of 0.001.

Further, TMS values of the sub-pixels and thicknesses of inks of the sub-pixels are compared with each other as follows:

Thickness of ink of red sub-pixel (nm)=−36.335× TMS value of red sub-pixel+10.981;

Thickness of ink of green sub-pixel (nm)=−9.3351× TMS value of green sub-pixel+5.2211; and Thickness of ink of red sub-pixel (nm)=−14.822× TMS value of blue sub-pixel+6.1433.

In the case of the red sub-pixel, the thickness of ink is changed by 36 nm per a TMS value of 0.001. In the case of the green sub-pixel, the thickness of ink is changed by 8 nm per the TMS value of 0.001. In the case of the blue sub-pixel, the thickness of ink is changed by 15 nm per the TMS value of 0.001. Subsequently, a difference in TMS values of adjacent sub-pixels is calculated (S30).

Stains are displayed due to a difference in the ink thicknesses of adjacent pixels. When the thickness difference is equal to or less than about 20 nm, no stain is generated. When an absolute value of the difference in TMS values of adjacent pixels is 0.001 or less, in the case of the red and blue sub-pixels, and 0.0015 in the case of the green sub-pixel, the difference in ink thicknesses of adjacent pixels is 20 nm or less.

That is, by calculating the difference in TMS values of adjacent sub-pixels, when the absolute value of the TMS differences of adjacent sub-pixels is 0.001 or less, in the case of is the red and blue sub-pixels, and 0.0015 in the case of the green sub-pixel, inkjet printing ends. However, when the absolute value of the TMS difference is larger than 0.001 in the case of the red and blue sub-pixels, or is larger than 0.0015 in the case of the green sub-pixels, the amount of ink discharged from each nozzle is adjusted (S40).

Subsequently, ink is reapplied to each pixel (S10). Then, the amount of the transmitted light is measured for each pixel (S20), and the TMS differences between the adjacent sub-pixels is calculated (S30), to calculate the thicknesses of the inks applied thereto. When the absolute value of the TMS difference is 0.001 or less in the case of the red and blue sub-pixels and 0.0015 or less in the case of the green sub-pixels, inkjet printing ends. When the absolute value is larger than 0.001 in the case of the red and blue sub-pixels and 0.0015 in the case of the green sub-pixel, the amount of ink discharged from each nozzle is adjusted (S40).

That is, until the absolute value of the TMS difference is 0.001 or less in the case of the red and blue sub-pixels and 0.0015 or less in the case of the green sub-pixels, the amount of ink discharged from each nozzle is adjusted. Then the ink is applied according to the adjusted amounts.

Figure 2:
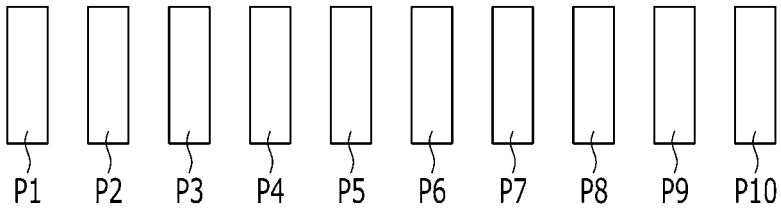
FIGS. 2, 3, and 4 are diagrams illustrating a method of adjusting an amount of ink applied to each pixel during the inkjet printing method, according to an exemplary embodiment is of the present invention.
Figure 3:
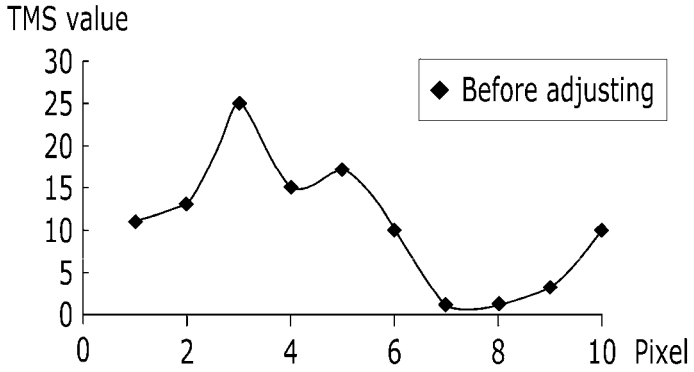
Figure 4:
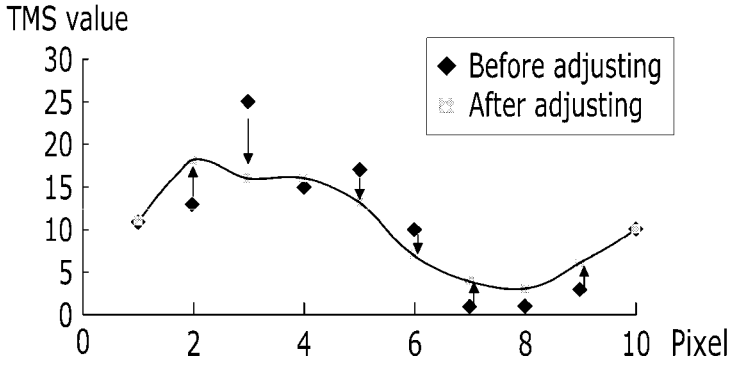

FIGS. 2 to 4 are diagrams illustrating a method for adjusting an amount of ink applied to each pixel, in the inkjet printing method according to the exemplary embodiment of the present invention. As shown in FIG. 2, ink is applied to 10 pixels P1 to P10. In this case, the applied ink includes red ink, green ink, and blue ink. The amounts of red, green, and blue ink applied to different sub-pixels of pixels P1 to P10 are compared to each other. That is, 10 red sub-pixels are compared with each other, 10 green sub-pixels are compared with each other, and 10 blue sub-pixels are compared with each other.

Subsequently, as shown in FIG. 3, the TMS value is measured for each of the is pixels P1 to P10. As shown in FIG. 3, large differences in TMS values occur between the second pixel P2 and the third pixel P3, and between the third pixel P3 and the fourth pixel P4. The large differences in the TMS values is indicative of large variations in ink thickness of adjacent pixels, i.e., between the sub-pixels of pixels P2 and P3 and between the sub-pixels of pixels P3 and P4. Therefore, stains may be generated by the differences in ink thickness.

Further, FIG. 3 shows that large differences in the TMS values occur between the sub-pixels of the fifth pixel P5 and the sixth pixel P6, between the sub-pixels of the sixth pixel P6 and the seventh pixel P7, and between the sub-pixels of the ninth pixel P9 and the tenth pixel P10. As such. stains may be aenerated therebetween.

Therefore, as shown in FIG. 4, the amount of ink applied to each sub-pixel is adjusted, by adjusting the amount of ink discharged from each nozzle. In this case, a criterion for adjusting the ink amount is an average of the TMS values of two adjacent pixels.

In the related art, the ink amount is adjusted on the basis of one value. Thus, a correction range of a pixel having a TMS value that is largely different from a criterion value is widened, and therefore, the number of ink applications increases. However, according to aspects of the present invention, the average of the TMS values of each two adjacent pixels may be used as the basis of the ink amount adjustment. In other words, the amount of ink applied to sub-pixels of adjacent pixels is compared. As a result, the number of ink applications is reduced.

Figure 5:
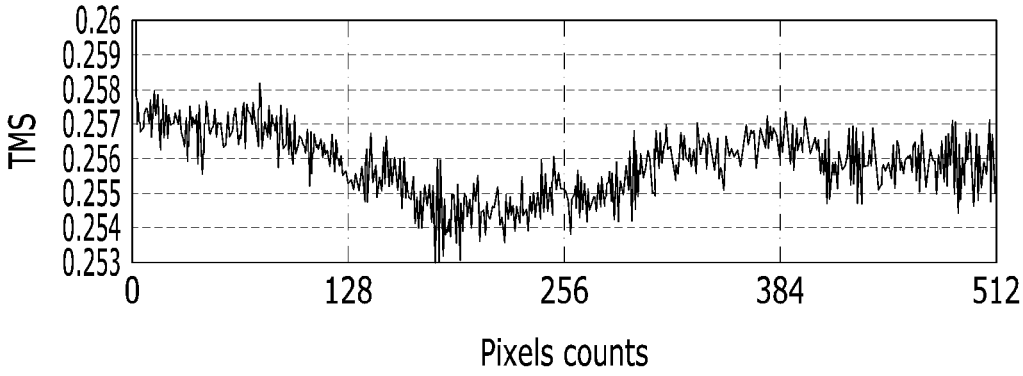
FIG. 5 is a graph illustrating a TMS value of each pixel, before adjusting amounts of ink applied to each pixel.
Figure 6:
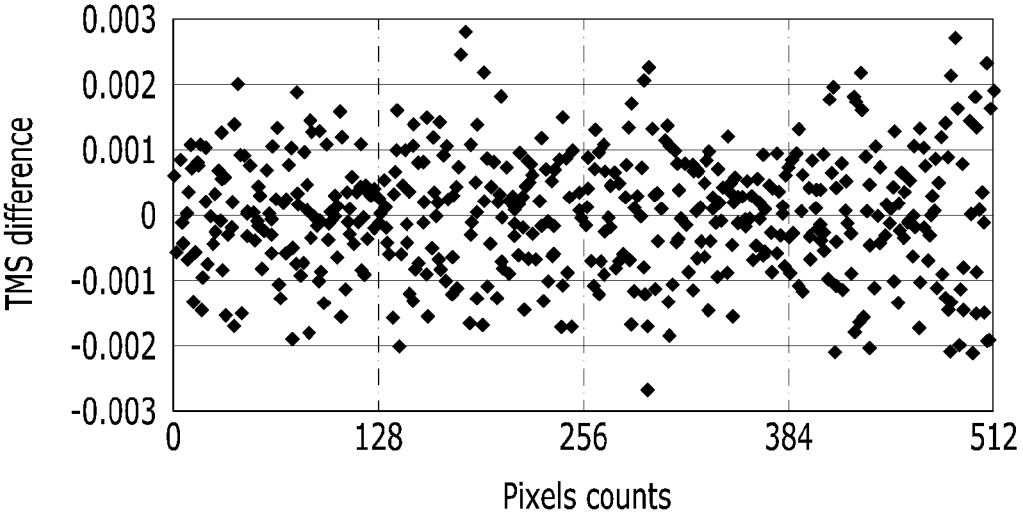
FIG. 6 is a graph illustrating a difference in TMS values between each two adjacent pixels, before adjusting amounts of ink applied to each pixel.

FIG. 5 is a graph illustrating a TMS value of pixels before adjusting amounts of red ink and blue ink applied to sub-pixels of the pixels, and FIG. 6 is a graph illustrating a difference in TMS values between adjacent pixels before adjusting amounts of red ink and blue ink applied to each pixel. The TMS values may be calculated for the sub-pixels of each pixel. As shown in FIGS. 5 and 6, the absolute value of the TMS differences between two adjacent is pixels is often larger than 0.001, before adjusting the amount of ink applied to each pixel. That is, numerous stains are generated between pixels.

Figure 7:
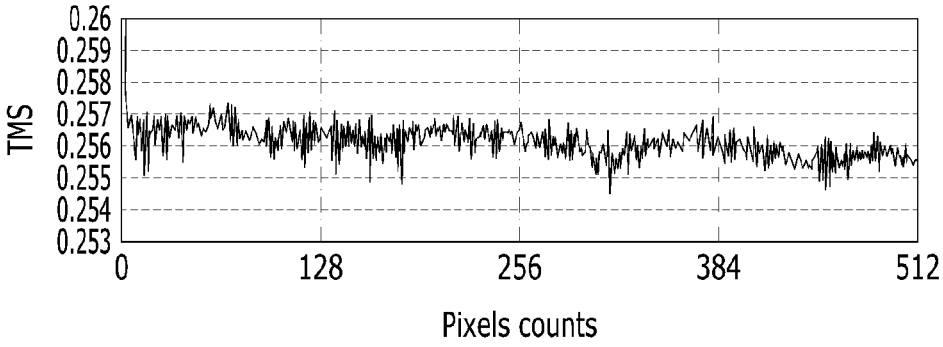
FIG. 7 is a graph illustrating a TMS value of each pixel, after adjusting amounts of ink reapplied to each pixel, on the basis of an average of the TMS values of each two adjacent pixels.
Figure 8:
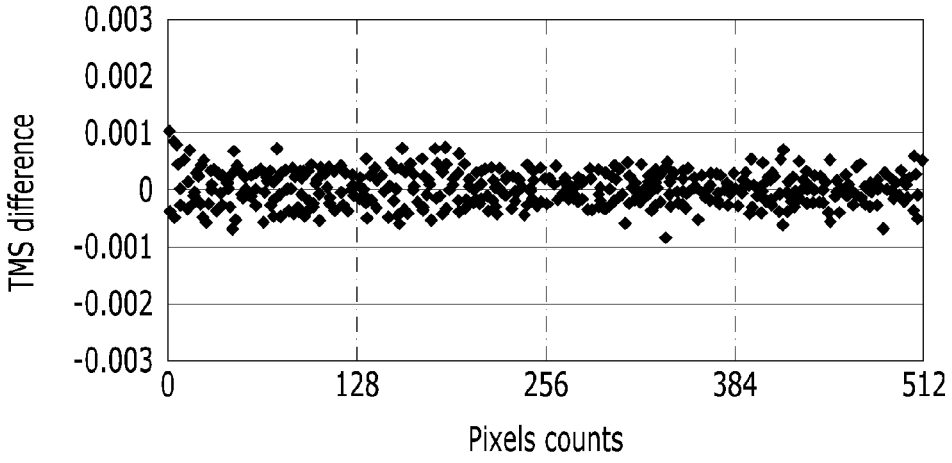
FIG. 8 is a graph illustrating a difference in TMS values of each two adjacent pixels, after adjusting amounts of ink reapplied to each pixel, on the basis of an average of TMS values of each two adjacent pixels.

FIG. 7 is a graph illustrating a TMS value of pixels after adjusting amounts of red ink and blue ink reapplied to each pixel, on the basis of an average of TMS values of adjacent pixels, and FIG. 8 is a graph illustrating a difference in TMS values of adjacent pixels, after adjusting amounts of red ink and blue ink reapplied to each pixel, on the basis of the average TMS values of adjacent pixels.

As shown in FIGS. 7 and 8, the absolute value of the TMS differences between adjacent pixels is 0.001 or less, after adjusting the amount of ink reapplied to each pixel, on the basis of the average TMS values of adjacent pixels. In other words, the TMS differences between the same color of sub-pixels of adjacent pixels are compared to a corresponding reference value. When the absolute value of the TMS differences is 0.001 or less, the difference in ink thicknesses is 20 nm or less. As a result, no stain is generated.

That is, it is possible to prevent the stains from being generated, by adjusting the amount of ink reapplied to each pixel, on the basis of the average TMS values of adjacent pixels. Further, in the case of the green sub-pixels, it is possible to prevent the stains by adjusting the absolute TMS value differences of adjacent pixels to be 0.0015 or less.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A method of inkjet printing pixels, comprising:

applying ink to the pixels using an inkjet printer head;

calculating a Transmittance Measurement System (TMS) value of each pixel by dividing an amount of light transmitted through the pixel after the ink is applied, by an amount of light transmitted through the pixel before ink is applied;

determining a TMS difference between two adjacent pixels, by taking the absolute value of the difference between the TMS values of the two adjacent pixels; and adjusting an amount of the ink in the two adjacent pixels, based on the average of the TMS values of the two adjacent pixels, if the corresponding TMS difference is greater than a corresponding reference value.

2. The method of claim 1, wherein the applying, the calculating, the determining, and the adjusting are repeated until each of the the TMS differences is less than or equal to the corresponding reference value.

3. The method of claim 2, wherein:

the applying of the ink comprises applying red ink, green ink, and blue ink to sub-pixels of the pixels, and the sub-pixels comprising the red ink or the blue ink correspond to a first corresponding reference value, and the sub-pixels comprising the green ink correspond to a second corresponding reference value.

4. The method of claim 3, wherein the first corresponding reference value is 0.001.

5. The method of claim 4, wherein the second corresponding reference value is 0.0015.

6. The method of claim 1, wherein the adjacent pixels are directly adjacent to one another.

7. A method of inkjet printing pixels, comprising:

applying ink to the pixels;

calculating a Transmittance Measurement System (TMS) value for sub-pixels of each pixel, by dividing an amount of light transmitted through each sub-pixel after the ink is applied, by an amount of light transmitted through each pixel before ink is applied;

determining a TMS difference of sub-pixels of each two directly adjacent pixels, by taking the absolute value of the difference between the TMS values of the sub-pixels of directly adjacent pixels; and applying an adjusted amount of ink to the sub-pixels, if any of the TMS differences is greater than a corresponding reference value.

8. The method of claim 7, wherein the applying of the adjusted amount of ink comprises applying an amount of the ink that is based on the average of the TMS values of each two directly adjacent pixels.

9. The method of claim 7, wherein:

the applying of the ink comprises applying red ink, green ink, and blue ink to the sub-pixels of each of the pixels, and the sub-pixels comprising the red ink or the blue ink correspond to a corresponding reference value of 0.001, and the sub-pixels comprising the green ink correspond to a corresponding reference value of 0.0015.

10. A method of inkjet printing pixels, comprising:

applying ink to the pixels;

calculating a Transmittance Measurement System (TMS) value for of each pixel, by dividing an amount of light transmitted through each after the ink is applied, by an amount of light transmitted through each pixel before ink is applied;

determining ink thickness differences between directly adjacent pixels, using the corresponding TMS values; and applying an adjusted amount of ink to the directly adjacent pixels that have ink thicknesses that differ from one another by more than a reference value.

* * * * *